United States Patent [19]

Pantek

[11] 4,108,220

[45] Aug. 22, 1978

[54] MULTIPLE USE CANNER

[76] Inventor: Stanley J. Pantek, 4244 Pantek Park, Attica, Mich. 48412

[21] Appl. No.: 809,438

[22] Filed: Jun. 23, 1977

[51] Int. Cl.[2] ..... B65B 3/04

[52] U.S. Cl. ..... 141/98; 7/110; 7/126; 294/28; 7/127

[58] Field of Search ..... 81/3.1 R, 3.4, 3.44; 7/1 R, 1 A, 3 R, 14.2 R, 14.2 S, 14.6; 294/28; 141/98, 328

[56] References Cited

U.S. PATENT DOCUMENTS 2,599,968 6/1952 Acard ..... 7/14.6

*Primary Examiner*—Houston S. Bell, Jr.

*Attorney, Agent, or Firm*—Clarence A. O'Brien; Harvey B. Jacobson

[57] ABSTRACT

A multiple use canner which includes a pair of elongated handle members pivotally interconnected at one of their ends and provided with hand grips at the other. Arcuate toothed gripping jaws are provided in the handle members adjacent the pivotal interconnection with the jaws for gripping and rotating a can lid onto or from a canning jar. A spring clip is disposed adjacent the hand grips to retain the jaws in secured position around the neck of a canning jar. The pivotal connection between the handle members comprises a vertically disposed pin having a socket receiving a depending stem on a funnel which is used for filling a canning jar positioned below the lower discharge end of the funnel when the handle members are secured to the neck of the jar. Attached to the pivotal ends of the handle members is an axially extending can lifting assembly comprising a pair of gripping jaws having arcuate jar engaging members which are oriented perpendicular to the jaws on the handle members and being pivotable about the axis which connects the ends of the handle members. Attachment means to secure the jar gripping assembly to the handle members enables the multiple use canner to lift jars out of hot water, such as when sterilizing jars. The canner is also used for holding, filling, lifting out of cold pack and opening jars, thereby rendering canning operations more efficient and eliminating problems in handling canning jars.

10 Claims, 6 Drawing Figures

MULTIPLE USE CANNER

BACKGROUND OF THE INVENTION

1. Field of the Invention

The present invention generally relates to canning implements and more particularly to a multiple use canner which includes a pair of pivotally connected jaws and handles for manipulating a canning lid and including features for supporting a filling funnel to facilitate filling the jars and a jar or can gripping assembly attached thereto to enable jars, cans, and the like, to be lifted out of a sterilizer, or the like, or otherwise lifting and handling jars, and the like, without the necessity of such items being directly engaged by the hands of a person engaged in a canning operation.

2. Description of the Prior Art

My prior U.S. Pat. No. 2,620,956, issued Dec. 9, 1952, discloses a canning implement utilized for filling cans and includes a pair of pivotally connected handle members having hand grips on the free ends thereof and arcuate jaws adjacent the pivotal connection together with a funnel supported in overlying relation to the jaws for alignment with the open end of the neck of a can or jar. While such device performed satisfactorily, it was not capable of performing several of the manipulative operations necessary in order to efficiently can various products in glass jars which are normally sterilized before filling and are necessarily handled in various manners during the canning operation including the application and, in some instances, the removal of screw threaded canning lids or canning lid rings.

The following U.S. patents also relate generally to this type of device:

U.S. Pat. Nos:

263,772 — Sept. 5, 1882
292,629 — Jan. 29, 1884
425,312 — Apr. 8, 1890
1,104,352 — July 21, 1914
1,254,371 — Jan. 22, 1918
1,569,405 — Jan. 12, 1926
1,814,014 — July 14, 1931
2,396,334 — Mar. 12, 1946
2,959,442 — Nov. 8, 1960.

SUMMARY OF THE INVENTION

The present invention generally relates to a multiple use canner and more particularly a device which can be utilized effectively when sterilizing jars by vertically lifting the jars when placed in a sterilizer and when removed therefrom, holding jars in various positions, filling jars, lifting jars out of a cold pack and rotating closure lids or closure lid rings in relation to the screw threaded neck of a jar.

Another object of the invention is to provide a canner in accordance with the preceding object in which a pair of elongated pivotally connected handles are provided with arcuate gripping jaws with teeth thereon for secure engagement with a canning lid and a spring clip to secure the jaws in position in encircling and gripping engagement with the neck of a can during the filling operation with a filling funnel being removably attached to the canner together with a gripping assembly removably attached to the outer end of the canner which includes a pair of gripping jaws oriented in perpendicular relation to the jaws on the handle members to facilitate gripping engagement with jars when the canner is oriented generally with the handle members extending vertically above the jar.

A further object of the invention is to provide a canner in accordance with the preceding objects in which the gripping assembly for jars includes a pair of pivotally connected members having arcuate jaws disposed in a plane parallel to the pivot axis which is coincidental to the pivot axis of the jaws on the handle members for gripping engagement with the neck of a jar when the handle members are oriented vertically above the jar.

Still another object of the invention is to provide a canner in accordance with the preceding objects in which the jaws on the handle members are in the form of arcuate rods and the gripping assembly includes downwardly opening channel-shaped members received over the handle members and pivotal retaining members for releasably securing the gripping assembly to the handle members, thereby enabling selective assembly and disassembly of the gripping assembly with the handle members.

Still another important object of the invention is to provide a canner which is capable of many uses during a canning operation, simple in construction, dependable in use and effective for performing its various functions.

These together with other objects and advantages which will become subsequently apparent reside in the details of construction and operation as more fully hereinafter described and claimed, reference being had to the accompanying drawings forming a part thereof, wherein like numerals refer to like parts throughout.

BRIEF DESCRIPTION OF THE DRAWINGS

FIG. 3 is a side elevational view of the canner being used to lift a jar from a sterilizer or the like.

DESCRIPTION OF THE PREFERRED EMBODIMENT

Figure 1:
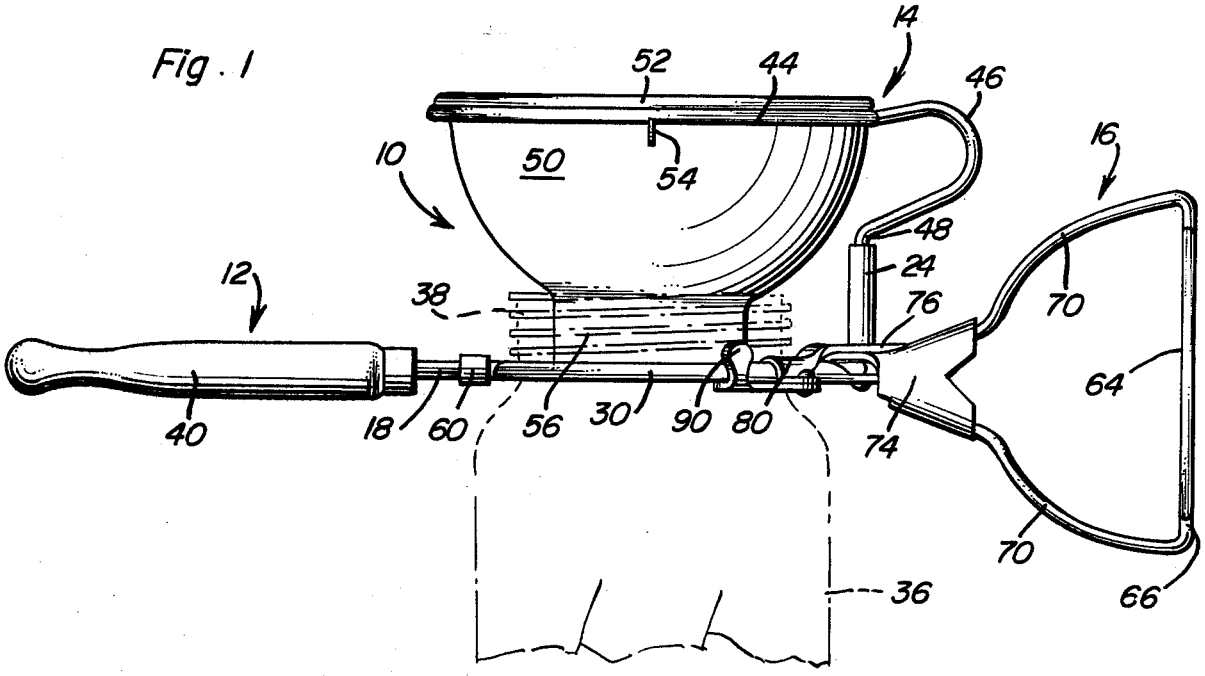
FIG. 1 is a side elevational view of the canner of the present invention illustrating the device in use for filling a can and the gripping assembly attached to the end thereof.

The multiple use canner of the present invention is generally designated by the numeral 10 and includes a handle assembly 12, a funnel assembly 14 detachably supported therefrom and a jar gripping assembly 16 also detachably connected thereto. The handle assembly 12 and funnel assembly 14 are somewhat similar to the structure illustrated in my prior U.S. Pat. No. 2,620,956, the structure of which is incorporated herein by reference thereto. The handle assembly includes a pair of handle members 18 and 20 of rod-like construction having flattened overlapping ends 22 pivotally interconnected by an elongated tubular hinge pin 24 having a hollow interior 26 defining a mounting socket for the funnel assembly 14 in a manner described hereinafter. The lower end of the hinge pin 24 is reduced and extends through the overlapping ends 22 of the handle members 18 and 20 and is riveted over as at 28 thus providing a secure pivotal connection between the handle members 18 and 20. The handle members 18 and 20 adjacent the flattened ends 22 are each provided with an arcuate jaw 30 and 32 respectively with each of the jaws including teeth 34 formed on the flattened inner surface thereof for secure gripping engagement with a can lid or a can lid ring to enable rotation of the can lid in relation to the jar 36. This use is not illustrated but it will be understood that the can lid is normally in screw threaded engagement with the threaded neck 38 of the jar 36 and it is frequently difficult to remove such can lids or can lid rings especially when it is desired to remove the can lid or can lid ring. Thus, with the handle members 18 and 20 moved towards each other, the teeth 34 on the jaws 30 and 32 will securely grip the can lid or can lid ring to enable it to be rotated in relation to the threads on the neck 38 of the jar 36. In order to manipulate the canner, each of the handle members is provided with an elongated hand grip 40 and 42 on elongated end portions of the handle members illustrated in FIGS. 1–3 thereby enabling the jaws 30 and 32 to be securely engaged with a can lid when it is desired to rotate the can lid in relation to the jar.

Figure 2:
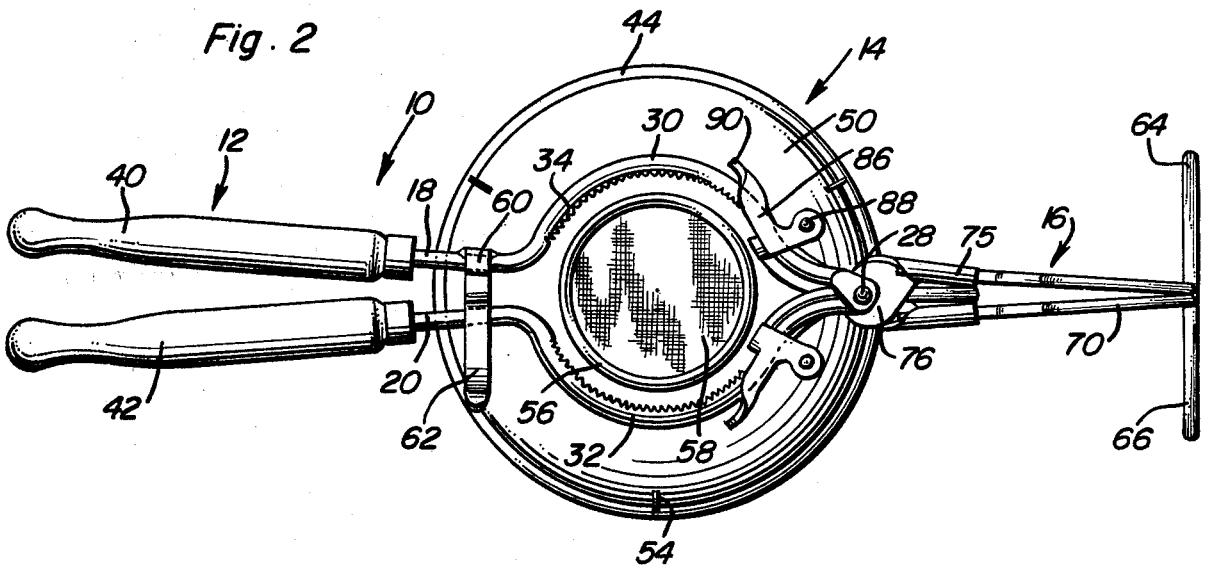
FIG. 2 is a bottom plan view of the assembly of FIG. 1.

The funnel assembly 14 includes an annular frame or ring 44 having an outwardly and downwardly curved handle forming loop member 46 thereon to facilitate manual handling of the funnel assembly 14. The handle member 46 terminates in a depending stem 48 parallel but offset from the center of the annular frame or ring 44 with the stem 48 being telescopically and detachably received within the socket defined by the hollow interior 26 of the hinge pin 24 as illustrated in FIG. 1. A funnel 50 is disposed within the annular frame or ring 44 and the upper end of the funnel 50 includes a rounded flange 52 overlying the annular frame or ring 44. The funnel 50 is constructed of plastic material preferably although it can be constructed of metal or the like and the annular frame or ring 44 may be in the form of a spring metal split ring frictionally gripping the funnel with the outer surface of the funnel 50 including small outward projections 54 which engage the undersurface of the annular frame or ring 44 thereby detachably securing the funnel to the frame. The lower end of the funnel 50 is provided with a depending cylindrical discharge end 56 which may or may not include a mesh screen 58 therein which is disposed at the juncture between the cylindrical discharge end 56 and the tapering curved portion of the funnel 50. The discharge end 56 is telescoped into the upper end of the neck 38 of the jar 36 due to the dimensional characteristics of the funnel and the mounting structure therefor so that the positioning of the discharge end 56 in the neck of the jar will assure proper alignment of the discharge end of the funnel with the jar. In order to secure the funnel assembly in place without continuous use of a hand, the handle member 18 is provided with a spring clip which includes a split cylindrical end 60 in gripping and mounting engagement with the handle member 18 and a pair of legs 62 normally spaced apart slightly less than the diameter of the rod which defines the handle member 20 so that the legs 62 will frictionally grip the handle member 20 and secure the jaws 30 and 32 in gripping engagement with the neck 38 of the jar 36. Thus, when the handle assembly and funnel assembly are assembled in relation to the open upper end of the neck 38 of the jar 36, both hands may then be utilized to fill the jar by pouring material into the open upper end of the funnel which will be maintained in alignment with the jar by virtue of the discharge end 56 thereof disposed below the upper end of the neck 38 of the jar 36 as illustrated in FIG. 1.

Figure 3:
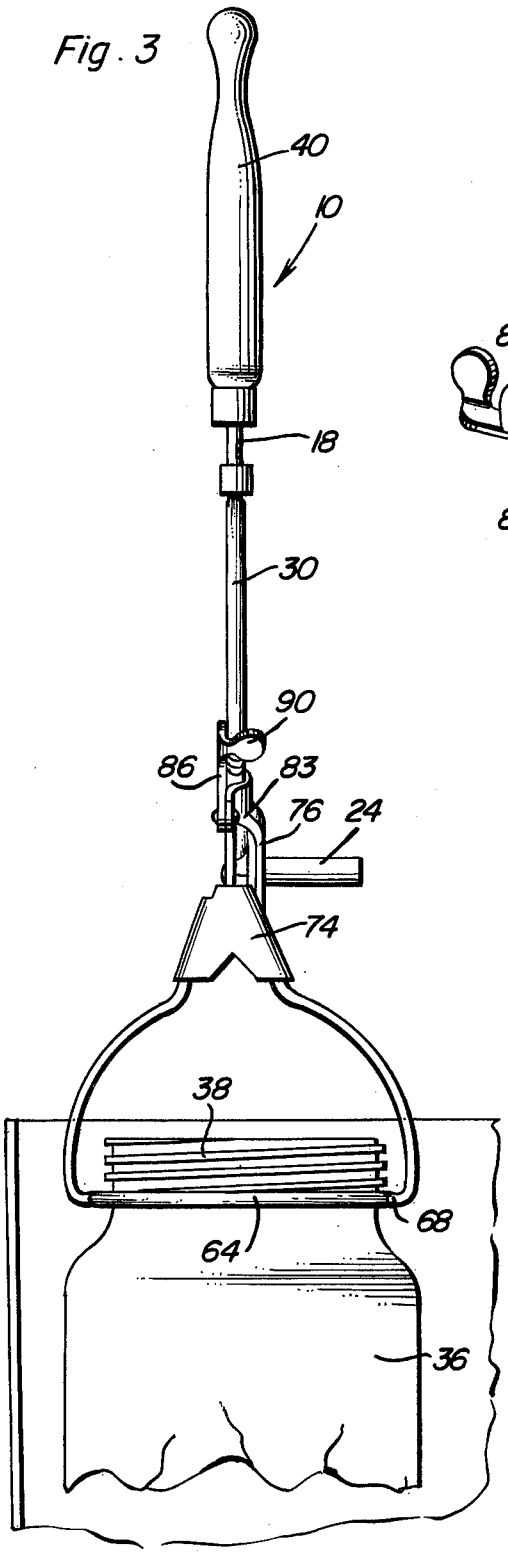
Figure 4:
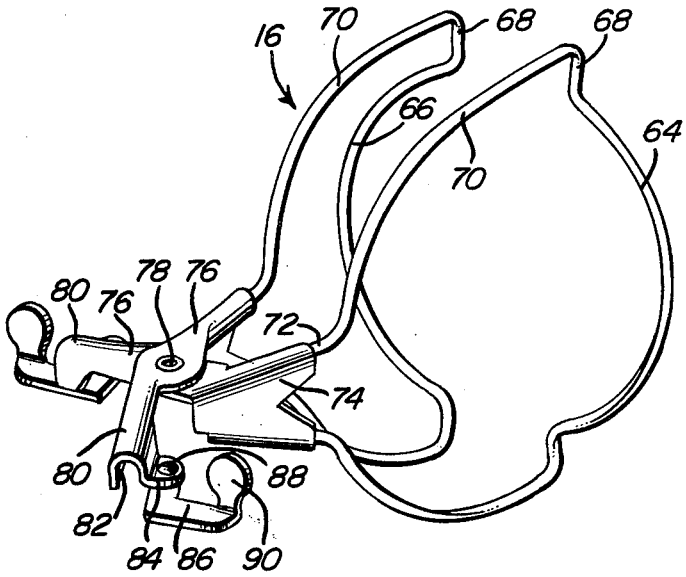
FIG. 4 is a perspective view of the gripping assembly illustrating the details of the attaching channels and pivotal retaining members.

The jar gripping assembly 16 includes a pair of arcuate gripping jaws 64 and 66 in the form of substantially rigid wire rods which have their concave edges facing each other and when disposed in adjacent relation define generally a circular or elliptical opening to grip the neck 38 of a jar 36 when engaged therewith in the manner illustrated in FIG. 3. The end portions of the jaws extend radially outwardly as at 68 a relatively short distance and the terminal end of each of the outwardly extending end portions 68 extend inwardly in an arcuately curved manner to form a pair of leg members 70 which terminate in straight inner end portions 72 which converge towards each other and which lie alongside the inner surface of a connecting plate 74 having outwardly diverging upper and lower edges crimped around the end portions 72 as at 75 thereby securely mounting the leg members 70 and the jaws 64 and 66, respectively, to the connecting plates 74. Each of the connecting plates 74 is provided with an extending arm 76 which is substantially perpendicular to the plate 74 and oriented in angular relation thereto with the arm 76 defining an extension of and being integral with the upper edge of the plate 74 as illustrated in FIG. 4. The angularly extending arms 76 are disposed in overlying and engaged relation with the portions of the arms 76 which overlie each other being substantially flat and being pivotally interconnected by a hollow rivet 78 integral with the lower extending arm 76 thereby enabling pivotal movement of the jaws 64 and 66 in relation to each other about an axis defined by the hollow rivet 78 with the pivotal axis being parallel to and defining the radius about which the jaws 64 and 66 swing.

Figure 5:
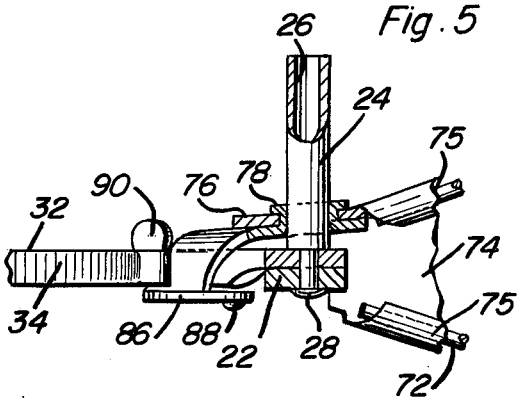
FIG. 5 is a detailed sectional view of the pivotal connection between the handle members and the association of the gripping assembly therewith.
Figure 6:
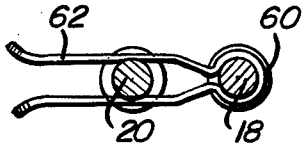
FIG. 6 is a detailed fragmental sectional view of the spring clip which retains the handle members in adjacent position.

Each of the arms 76 terminates in a downwardly opening channel-shaped extension 80 which defines a generally semi-cylindrical channel or groove 82 in the bottom thereof which is disposed below the flat overlapping portions of the arms 76 by virtue of a slightly offset portion 83 formed in the arms 76 outwardly of the hollow rivet 78. The channel or groove 82 is shaped to fit over and receive the ends of the rod-like handle members 18 and 20 adjacent the hinge pin 24 with the hollow rivet 78 being telescoped over the hinge pin 24 as illustrated in FIG. 5. Thus, in assembling the gripping assembly 16 onto the handle assembly 12, the hollow rivet 78 is telescoped over the hinge pin 24 and the channels or grooves 82 are positioned so that the rod-like handle members 18 and 20 adjacent the hinge pin 24 will be received substantially completely therein. Each of the extensions 80 on the arms 76 has an outwardly extending pivot lug 84 at the free outer end thereof generally in alignment with the bottom edge thereof for pivotally supporting a retaining latch member 86 which is generally of L-shaped configuration with the short leg thereof pivoted to the lug 84 by a hinge rivet 88. The free end of the latch member 86 is provided with an upwardly extending finger-engaging lug 90 to facilitate movement of the retaining latch member from the position illustrated in FIG. 4 so that it is completely removed from under the downwardly opening channel 82 to a latching position where a longitudinal portion of the elongated leg on the L-shaped retaining latch member will underlie the downwardly opening channel or groove 82 and engage the bottom of the rod-like handle member 18 or 20 thereby securely mounting the arms 76 and thus the gripping assembly to the handle members 18 and 20 with the hollow rivet 78 engaged with the hinge pin 24 stabilizing the gripping assembly so that, in effect, the arms 76, leg member 70 and jaw 64 form continuations of extensions of the handle members 18 and 20 which, in effect, intersect and cross at the hinge axis defined by the hinge pin 24. This enables the handle assembly and gripping assembly to be utilized in the manner illustrated in FIG. 3 to handle and lift jars in relation to a sterilizer, cold pack and the like with the jaws 64 and 66 being oriented perpendicular to the jaws 30 and 32 but swingable about the same hinge axis.

In using the device to fill jars, the handle assembly 12 is secured to the neck 38 of the jar 36 by bringing the hand grips 40 and 42 which may be constructed of wood, plastic or the like towards each other with the spring clip retaining the handle assembly in position on the jar. The handle assembly is positioned with the vertical hinge pin 24 extending upwardly. The funnel assembly 14 is then grasped by the handle loop 46 and the stem 48 inserted downwardly into the socket formed by the hollow interior 26 of the hinge pin 24 with the cylindrical discharge end 56 of the funnel 50 aligned with the neck 38 so that it will enter into the open upper end of the neck 38 when the stem 48 telescopes downwardly into the hinge pin 24 to the position illustrated in FIG. 1. The jar 36 may then be filled and this structures enables both hands to be used when filling the jar since the handle assembly retains the funnel on the jar and the discharge end of the funnel maintains the funnel aligned with the open end of the jar. This function is capable of being performed when the jar gripping assembly 16 is assembled onto the handle assembly or when the jar gripping assembly 16 has been removed therefrom.

When it is desired to rotate a screw threaded jar lid or jar lid ring in relation to the screw threaded neck 38 of the jar 36, the two arcuate jaws 30 and 32 are moved towards each other by manipulating the hand grips 40 and 42 until the teeth 34 engage the jar lid which sometimes is provided with serrations which match with the teeth and then by swinging the hand grips 40 and 42 in an arcuate path, the jar lid or jar lid ring may be rotated in relation to the neck of the jar such as when removing a tight jar lid from the jar. Usually, during the jar lid rotating operating, the funnel assembly 14 would be detached from the handle assembly 12 and the jar gripping assembly 16 may be attached or detached during this operation.

When using the canner 10 to lift jars 36 from a sterilizer 37 or other container such as a cold pack or the like, the device is vertically oriented as shown in FIG. 3. The arcuate configuration of the jaws 64 and 66 is such that they will effectively grip opposite sides of jar necks of different standard diameters and the positioning of the gripping assembly 16 as an axial extension of the handle assembly 12 enables various items to be picked up and lifted effectively without direct contact between the items and the hands of the individual performing the canning operation, thereby eliminating the possibility of burns or scalding and also maintaining the sterile condition of the sterilized cans and the like. The multiple use canner enables substantially all of the operations performed on the cans and associated components to be handled effectively and also enables effective rotation of can lids or can lid rings and efficient filling of the cans with the product by using the funnel.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A multiple use canner comprising a pair of elongated handle members, means pivotally interconnecting said handle members, jaw means on each of said handle members disposed in opposed relation for movement toward and away from each other, a gripping assembly forming an extension of the handle members, means detachably securing the gripping assembly to the handle members, said gripping assembly including a pair of jaw members oriented in perpendicular relation to the jaw means and movable toward and away from each other in response to pivotal movement of the handle members in relation to each other to enable the jaw means to engage a supporting structure when disposed in one plane and the jaw members to clampingly engage a support when oriented in a plane perpendicular to the first mentioned plane.

2. The structure as defined in claim 1 wherein said handle members are pivotally interconnected at one end thereof, said means pivotally interconnecting the handle members including a pivot pin extending laterally from said handle members, said gripping assembly including a pair of legs extending from the jaw members with each of the legs including an arm attached thereto, said arms being disposed in pivotal overlapping and intersecting relationship, the pivot axis of the arms of the gripping assembly being defined by a hinge pin connecting the ends of the handle members.

3. The structure as defined in claim 2 wherein said means detachably securing the gripping assembly to the handle members includes a downwardly opening channel-shaped groove on the end of each of said arms receiving a portion of each handle member therein adjacent the hinge pin and pivotal retaining means mounted on each of said arms for closing the lower end of the channel-shaped groove and retaining the handle member therein, thereby securing the arms to the handle members.

4. The structure as defined in claim 3 wherein said jaw members are in the form of substantially rigid wire members of generally semi-circular configuration.

5. The structure as defined in claim 1 wherein said jaw means are each in the form of an arcuate rod-like member having a flattened concave surface provided with a plurality of gripping teeth thereon.

6. The structure as defined in claim 1 together with a spring clip mounted on one of said handle members and frictionally engaging the other of the handle members for retaining the handle members in adjacent relation with the jaw means engaged with a support.

7. The structure as defined in claim 1 together with a funnel disposed above the handle members and including a discharge end of alignment with and adjacent the jaw means, said funnel including a depending support stem attached thereto and engageable with the means pivotally interconnecting the handle members.

8. The structure as defined in claim 7 wherein said means pivotally interconnecting the handle members includes a hollow hinge pin defining a socket, said means on the funnel for supporting the same including a depending stem telescopically received in the socket whereby the funnel will be oriented in alignment with the open end of a neck of a canning jar when the jaw means on each of the handle members are engaged with the external surface of the neck of the jar to facilitate filling of the jar, said jaw means on each of the handle members adapted to grip a jar lid or jar lid ring for rotating the same with respect to the jar, said gripping assembly adapted to grip and lift the neck of a jar when the handle members are oriented in vertical orientation above the upper end of a jar, such as when oriented in a sterilizer, cold pack or the like.

9. A canning jar lifting assembly adapted to be attached to a jar lid remover and jar filler assembly which includes a pair of pivotally connected handle members having a laterally extending pivot pin at one end thereof, said jar lifting assembly including a pair of pivotally interconnecting jaw members having a pivot axis coincidental with and received on the hinge pin interconnecting the handle members, and means on the jaw members detachably connected to the handle members of the jaw lid remover and jar filler assembly, said jaw members being in coacting relationship with the handle members.

10. The structure as defined in claim 9 wherein said jaw members are of arcuate configuration and disposed in opposed relation with the radius of curvature of the jaw members having an axis perpendicular to the pivotal axis thereof.

* * * * *